US006142644A

United States Patent [19]

Leung

[11] Patent Number: 6,142,644

[45] Date of Patent: Nov. 7, 2000

[54] FLASHLIGHT WITH SLOW MOTION LAMP ASSEMBLY

[76] Inventor: Chan Sik Leung, Flat F, 2/F, Block 8, Lily Mansion, Site 9, Whampoa Garden, Kowloon, The Hong Kong Special Administrative Region of the People's Republic of China

[21] Appl. No.: 09/299,755

[22] Filed: Apr. 27, 1999

[51] Int. Cl.[7] ..... A47B 19/00

[52] U.S. Cl. ..... 362/98; 362/99; 362/157; 362/197; 362/198

[58] Field of Search ..... 362/98, 99, 105, 362/128–134, 135, 137, 147, 155, 157, 190, 191, 197, 198, 208, 269, 274, 288, 310

[56] References Cited

U.S. PATENT DOCUMENTS

| | | | |
|---|---|---|---|
| 4,432,042 | 2/1984 | Zeller | 362/183 |
| 4,598,340 | 7/1986 | Dwosh et al. | 362/98 |
| 5,442,528 | 8/1995 | Vandenbelt | 362/98 |
| 6,022,119 | 2/2000 | Botty, Jr. | 362/98 |

*Primary Examiner*—Sandra O'Shea
*Assistant Examiner*—Ismael Negron
*Attorney, Agent, or Firm*—Allen R. Morganstern, Esq.

[57] ABSTRACT

A portable lamp, such as a flashlight or small reading lamp, has a smooth rotatable light bulb portion that rotates evenly from a closed to an open position. The lamp includes a barrel-shaped illuminator within a main housing. The lamp housing is rotatable between a closed lamp-off position and a full-open lamp-on position in a smooth, slow motion movement from the closed to the open, lamp illuminating position. A torsion coil spring urges the lamp housing to rotate into the full-open position. The torsion coil is mounted in a hollow interior of a drum mounted rotatably within a diameter-matching cylinder, which has an inner surface. The drum has a corresponding outer surface in close proximity to the inner surface of the cylinder. The outer surface of the drum has a damper, such as a coating of friction-producing grease, which provides a fluid shear counter force to slow the rotational motion of the lamp housing. The torsion coil spring is prestressed and torqued so as to bias and urge the lamp housing to assume the open position, to expose the light source, such as the light bulb, therefrom. The portable lamp is attachable to a fixed object, such as a book, for convenient illumination of a desired location by an attachment means, such as a clip.

16 Claims, 6 Drawing Sheets

FLASHLIGHT WITH SLOW MOTION LAMP ASSEMBLY

FIELD OF THE INVENTION

The present invention relates to portable lamps, such as flashlights and small reading lamps, with smooth rotating lamp illuminators.

BACKGROUND OF THE INVENTION

A small flashlight with an attached clamp can be used for many applications where light is required to perform a task. It is desirable to be able to easily orient the device to aim the light accurately and conveniently.

In addition, some method of covering the lens to protect it from scratches when not in use is sometimes incorporated. Often a removable cover is used. This is susceptible to being lost when it is removed.

Another problem with flashlights is that the user sometimes forgets to turn it off after use.

OBJECTS OF THE INVENTION

It is therefore an object of the present invention to provide a small flashlight with attached clamp permitting three degrees of freedom in orienting the light relative to the clamp.

It is a further object of the present invention to combine the functions of lens protection with electrical turn off of the lamp.

It is another object of the present invention to provide automatic slow motion rotation of the lamp assembly from the protected position combined with automatic turn on of the lamp.

It is a further object of the present invention to provide these features in an ergonomic design that is compact and convenient to use.

It is also an object of the present invention to provide simple intuitive operation of the features.

It is also an object of the present invention to provide a hand-held flashlight or reading lamp with a smooth rotating lamp illuminator.

It is an object of the present invention to provide a flashlight or small reading lamp with a lamp illuminator housing that is rotatable between a closed lamp-off position and a full-open lamp-on position.

It is also an object of the present invention to provide a flashlight or small reading lamp that provides for slow-motion rotation between said closed and full-open positions.

It is yet an object of the present invention to provide a torsion means for urging the lamp housing to rotate into the full-open position.

It is yet further an object of the present invention to adjust the position of the lamp to a user desired direction of illumination from the lamp.

It is also a further object of the present invention to attach the flashlight or small reading lamp to a fixed object for convenient illumination of a desired location.

It is further an object of the present invention to lock the lamp to any one of a plurality of selectable open positions.

SUMMARY OF THE INVENTION

In keeping with these objects and others which may become apparent, the present invention includes a portable lamp, such as a flashlight or small reading lamp, which has a smooth rotatable light bulb portion that rotates evenly from a closed to an open position. The lamp includes an illuminator with a main housing which is preferably barrel-shaped, mounted within an end of the main housing. The illuminator has one or more electrically energized lamps mounted therein.

The lamp housing is rotatable between a closed lamp-off position and a full-open lamp-on position. The light bulbs are electrically connected to a power source, such as one or more batteries by a electrical switch for alternately turning said lamp on and off.

The batteries are located in a battery compartment of the main housing. A battery door has a finger-push releasable spring mounted on the door to allow user access to the batteries installed in the battery compartment.

To accomplish a smooth, slow motion movement of the rotatable lamp housing from the closed to the open, lamp illuminating position, there is first a torsion coil spring that urges the lamp housing to rotate into said full-open position.

There is a slow-motion rotation of the lamp housing between the closed and the fully-open positions, which is caused by the torsion coil being mounted in a hollow interior of a drum. The drum is mounted rotatably within a diameter-matching cylinder, wherein the drum and the cylinder are attached within the barrel shaped lamp housing.

The cylinder has an inner surface and the drum has an outer surface in close proximity to the inner surface of the cylinder.

The outer surface of the drum has a friction resistance rotational motion damper that resists, but does not prevent, the rotational motion of the drum within the corresponding diameter-matching cylinder.

The torsion coil spring is prestressed and torqued so as to bias and urge the lamp housing to assume the open position, to expose the light source, such as the light bulb, therefrom.

The rotational motion damper includes a coating of friction-producing grease disposed on the outer surface of the drum. The grease is in a layer disposed between the outer surface of the drum and the inner surface of the diameter-matching cylindrical bore. The grease provides a fluid shear counter force to slow the rotational motion of the lamp housing from the closed shut position to the open, illuminating position.

The portable lamp is attachable to a fixed object, such as a book, for convenient illumination of a desired location by an attachment means, such as a clip. The clip has a spring mounted therein and is attached to a rotation collar with molded serrations and a bore therethrough with a fastener passing through the bore and into the main housing.

The lamp adjuster adjusts rotation of the lamp and lamp housing to a user desired direction of illumination from the lamp. When the barrel is in place, the user can adjust the angle of position of the beam of light therefrom about the vertical, horizontal and longitudinal axes of rotation with an adjuster which has a plurality of teeth radially mounted on a perimeter of the barrel-shaped lamp housing. The teeth cooperate with a locking means which provides a plurality of discrete click-stop settings for positions of the lamp housing.

This allows the lamp housing and lamp to be rotated by a user to any one of a plurality of selectable open illuminating positions exposing the beam of light therefrom.

The barrel-shaped lamp housing is locked into place by a lock with a push-button attached to a spring which is mounted within the main housing. The spring engages at least one nib projecting from the main housing in releasable contact with teeth in a pawl-and-ratchet fashion. User pressure on the push-button causes the spring to be released from contact with the teeth, thereby allowing the barrel-shaped lamp housing to incrementally rotate.

BRIEF DESCRIPTION OF THE DRAWINGS

The present invention can best be described in conjunction with the accompanying drawings, in which.

DETAILED DESCRIPTION OF THE PREFERRED EMBODIMENTS

Figure 1:
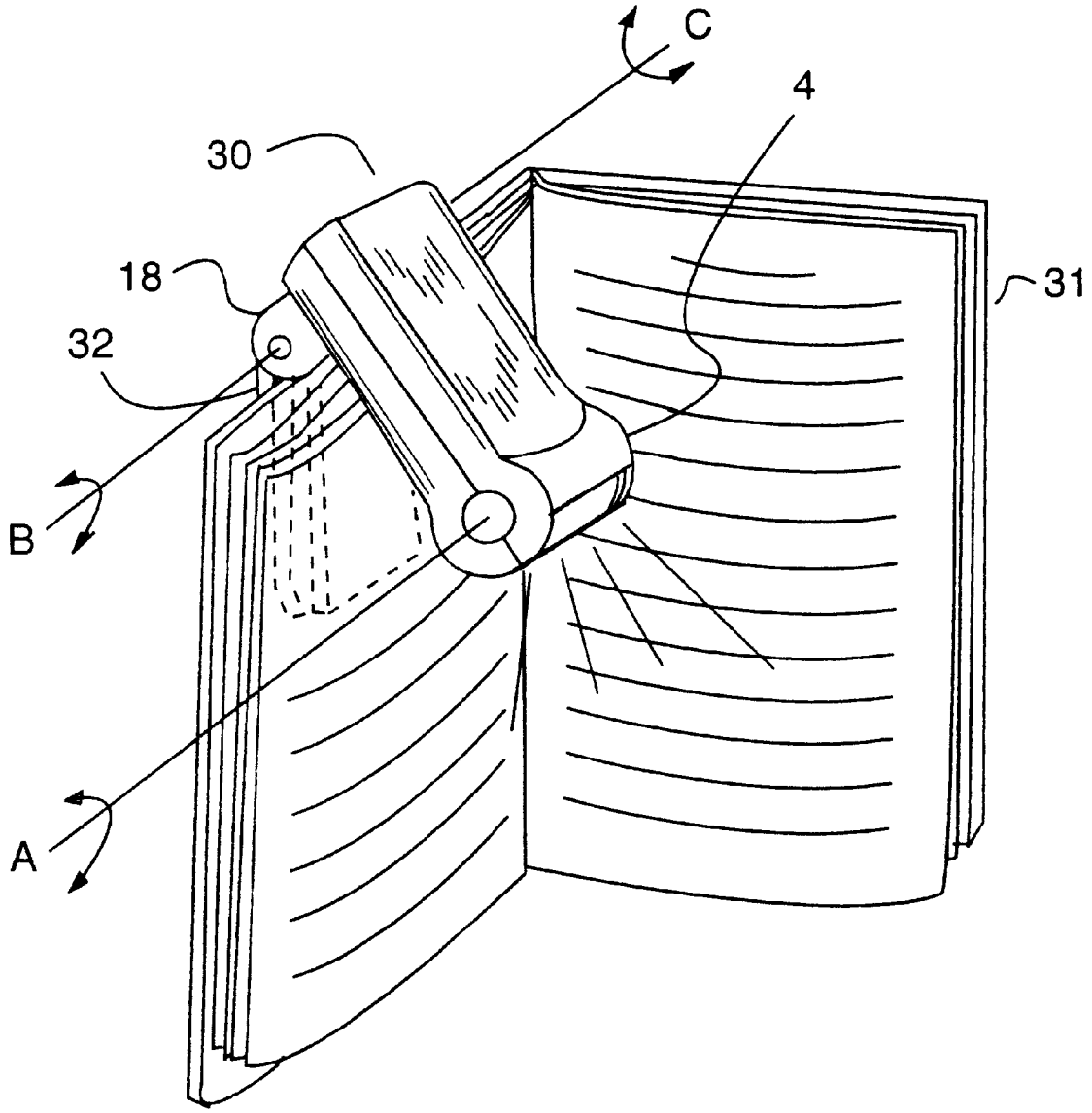
FIG. 1 is a perspective view of the flashlight of the present invention, illustrating the three degrees of freedom of orientation.

FIG. 1 shows flashlight 30 of the present invention clamped to a book 31 by clamp 32. The use of flashlight 30 as a reading light while clamped to a book 31 is only one application, since clamp 32 can attach the flashlight to a wide variety of surfaces.

FIG. 1 is further used to illustrate the three axes of rotation which afford wide orienting capability. Axis A is aligned with the axis of rotatable lamp housing 4. Lens 1 of lamp 3 (FIG. 6) can be rotated from a protected position aimed toward the body of flashlight 30 to a position 180 degrees away pointing the lamp straight out the end of flashlight 30.

Bracket 18 is capable of being pivoted about axis B in relationship to clamp 32 to permit the body of flashlight 30 to be swung away from the jaws of clamp 32 and is aligned in parallel with the axis of clamp 32.

Finally, an axis C permits the flashlight 30 to be rotated laterally with respect to bracket 18. All three motions have click stops to insure stability of the orientation.

Figure 2D:
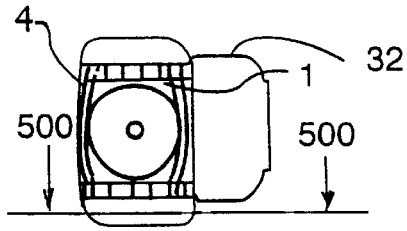
FIG. 2D is a top elevational view of the flashlight depicted in FIG. 1 in a fully open position.
Figure 2A:
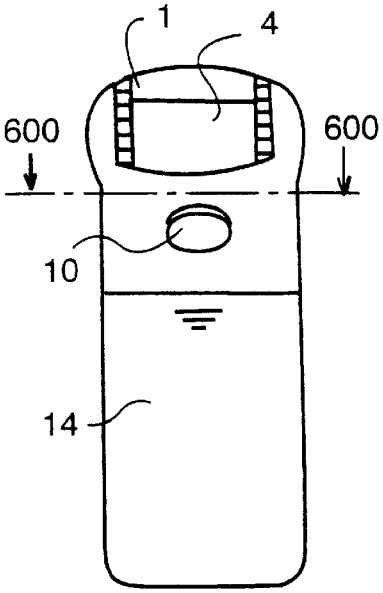
FIG. 2A is a front elevational view of the flashlight depicted in FIG. 1 in a fully open position.
Figure 2B:
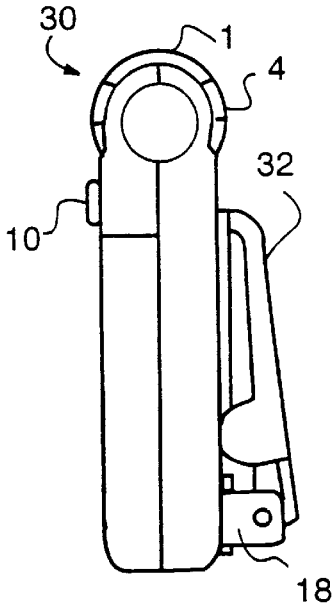
FIG. 2B is a side elevational view of the flashlight depicted in FIG. 1 in a fully open position.
Figure 2C:
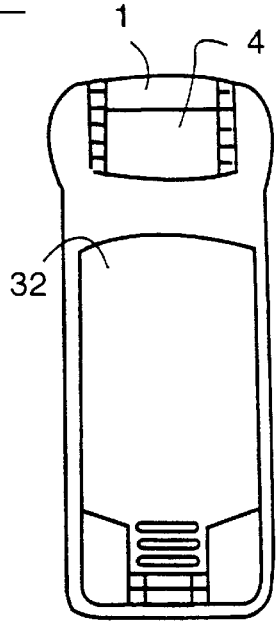
FIG. 2C is a rear elevational view of the flashlight depicted in FIG. 1 in a fully open position.
Figure 2E:
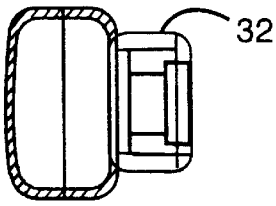
FIG. 2E is a bottom elevational view of the flashlight depicted in FIG. 1 in a fully open position.
Figure 4:
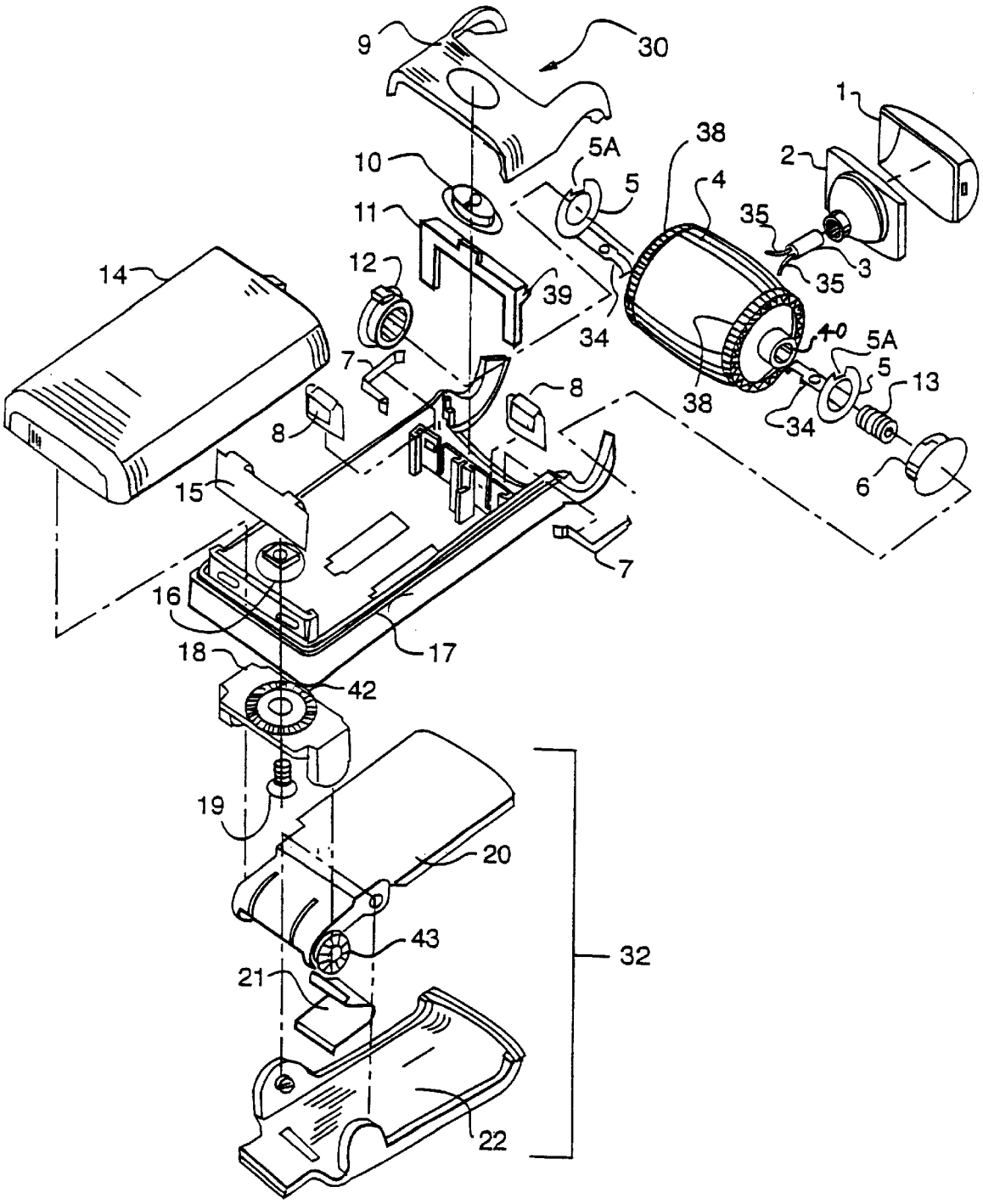
FIG. 4 is a perspective exploded view of the parts of the flashlight depicted in FIG. 1.

FIGS. 2A, 2B, 2C, 2D, 2E show five different plan views of flashlight 30 and along with FIG. 4, illustrate the basic components of the device. Removable battery cover 14 is shown in FIGS. 2A and 4. Also, button 10 is used to release lamp housing 4 to rotate from the protected position in slow motion to the fully open position as shown therein. Transparent lens 1 is shown in FIGS. 2 A through 2D.

Figure 3:
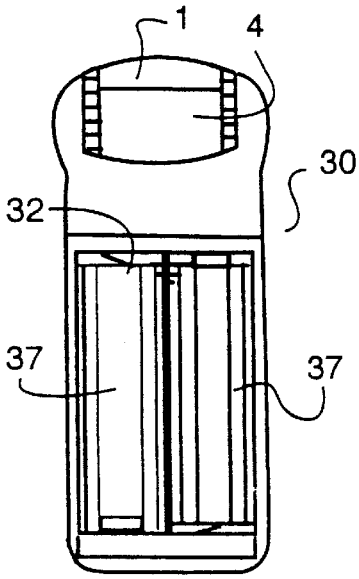
FIG. 3 is a phantom front elevational view of the flashlight depicted in FIG. 1 showing the location of batteries.

FIG. 3 is a phantom view of flashlight 30 as depicted in FIG. 2A showing the location of batteries 37. Although the size of flashlight 30 can be varied to accommodate different sized batteries and lamps, the illustrations are of a configuration using two size "AA" cells.

FIG. 4 shows an exploded view of the various component parts of flashlight 30. Main housing 17 has the battery compartment and side supports to engage lamp housing 4. Transparent lens 1 snaps into lamp housing 4.

Lamp 3 has two rigid wire leads 35, and it fits through a central hole in metallized reflector 2. Teeth 38 on either side of lamp housing 4 engage nibs 39 on plastic spring member 11, which is also illustrated in FIG. 5, to stop the rotation at any desired intermediate point, by either releasing button 10 during the slow motion automatic rotation of lamp housing 4, or by manually rotating lamp housing 4.

Cowl 9 snaps into housing 17 to capture lamp housing 4. End caps 6 and 12 fit between housing 17 and cowl 9 to provide bearings for lamp housing 4. Torsion coil spring 13 provides the motive power for the automatic rotation of lamp housing 4. Torsion coil spring 13 is wound up manually by the user thereby storing energy when lamp housing 4 is rotated to the protective position.

Figure 5:
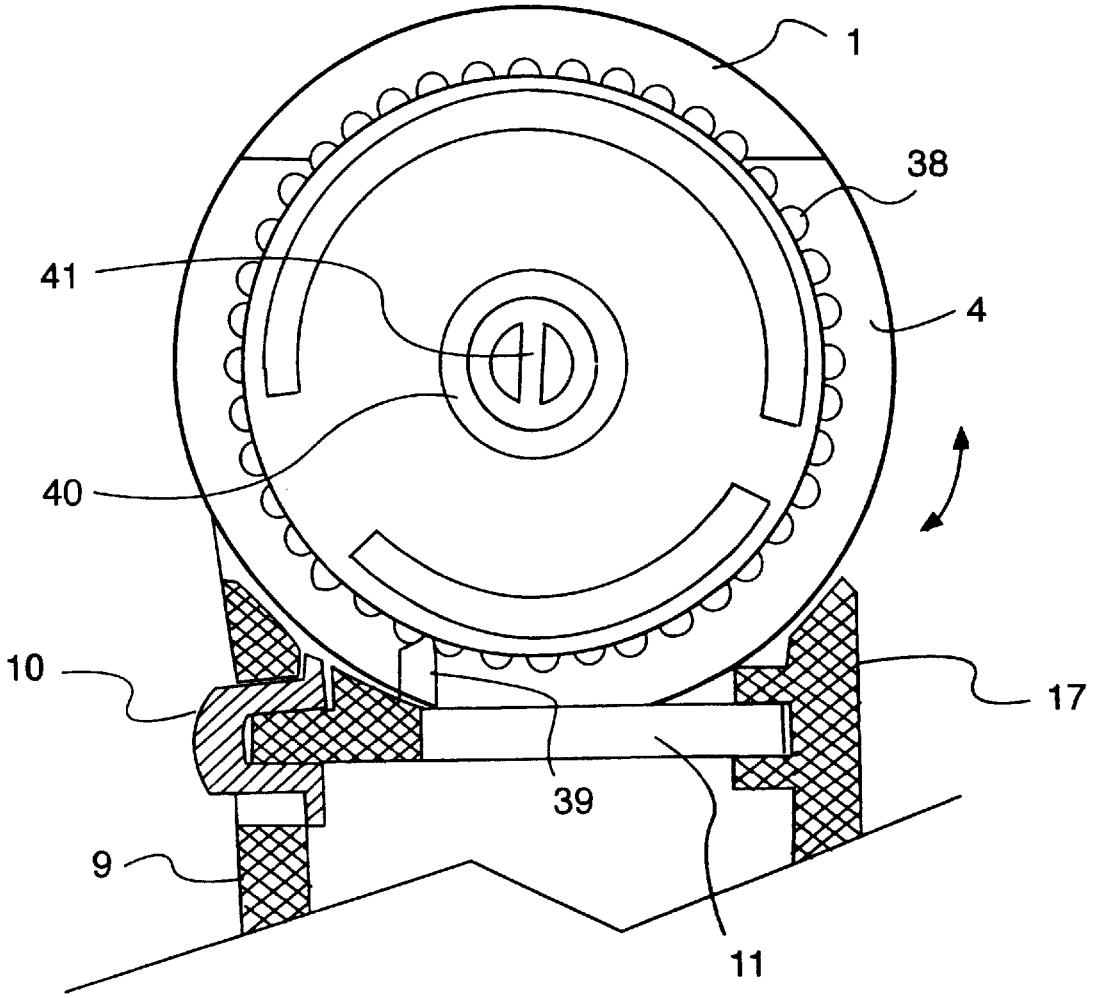
FIG. 5 is a partial cross-sectional view of the lamp assembly of the flashlight depicted in FIG. 2B and taken along line 500—500.

One end of torsion coil spring 13 is captured by groove 41 formed by molded bosses as formed in lamp housing 4, as shown in FIG. 5. The distal end of spring 13 is kept stationary by similar capture (not shown) within end cap 6.

Figure 6:
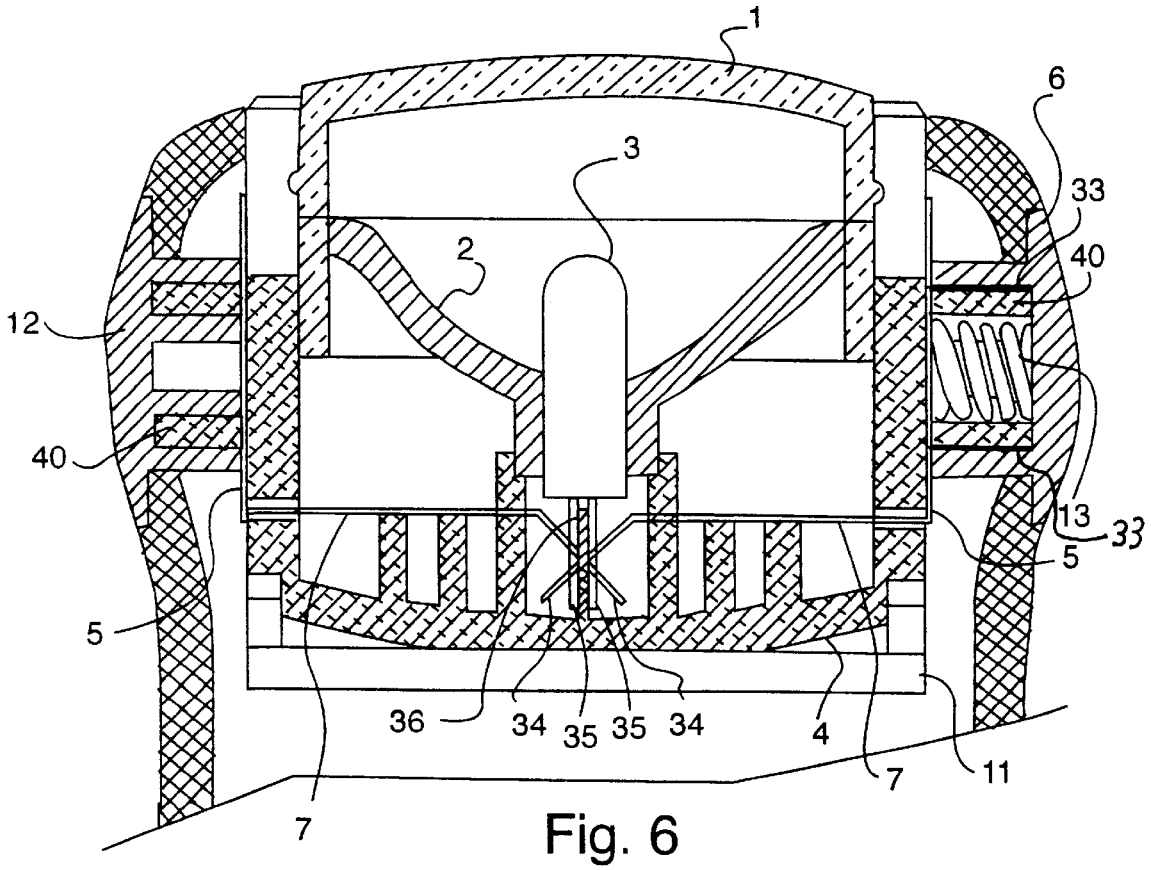
FIG. 6 is a partial cross-sectional view of the lamp assembly of the flashlight depicted in FIG. 2A and taken along line 600—600.

This relationship can be understood by reviewing the cross sectional view of FIG. 6. To prevent spring 13 from rapidly rotating lamp housing 4 when button 10 is actuated, thick substrate layer of grease 33 is applied between bosses 40, which forms the axles of lamp housing 4 as related to end cap 6 (and end cap 12) and the recess formed in end cap 6, which forms the corresponding bearing surfaces. It should be noted that although in FIG. 6 (and in FIG. 4) only one spring mechanism is illustrated in accordance with the above as related to end cap 6, it is within the scope of the invention to utilize said spring mechanism configuration as related to end cap 6 also in conjunction with end cap 12, either in place thereof or in addition thereto as discussed herein and as illustrated in FIGS. 4 and 6.

This layer of grease 33 as referred to above slows the rotation of lamp housing 4 by a fluid shear counter force which is a function of the speed of rotation. Although the spring force is not constant throughout the rotation from protected (i.e. closed) position to fully open position, the counter force of layer of grease 33 is also not constant in a compensatory sense, thereby interacting so as to maintain a nearly constant slow motion rotational velocity of lamp housing 4 when the actuation of button 10 when the flashlight is in its closed position rotational movement of lamp housing 4 and this transparent lens 1. This smooth, slow motion is achieved in a simple noiseless inexpensive mechanism.

Bracket 18 which attaches clamp 32 to housing 17, via screw 19 and nut 16, permits rotation relative to housing 17 with click stop control achieved by the engagement of raised nibs on the surface of housing 17 (not shown) and the molded serrations 42 formed in bracket 18.

Clamp 32 includes back jaw 20, front jaw 22 and closing spring 21. Clamp 32 is pivoted on bracket 18 with nibs (not shown) which engage serrations 43 on back jaw 20, to facilitate positioning at a desired angle relative to housing 17.

The electrical components of flashlight 30 can be seen in FIGS. 4 and 6. The electrical components include bottom battery spring contact bridge 15, output battery spring contacts 8, switch brushes 7, switch members and lamp contacts 5 and lamp 3. Switch brushes 7 are leaf spring members which connect electrically at one of their ends to battery contacts 8 while the other ends of switch brushes 7 are in sliding electrical contact with lamp contacts 5.

Lamp 3 fits over a central rib 36 molded as part of lamp housing 4. The leads 35 straddle rib 36 while ends 34 of switch member and lamp contacts 5 contact and hold leads 35 physically thereby restraining lamp 3. The switch members and lamp contacts 5 have a notch 5A strategically placed on the periphery thereof so as to be aligned with their respective switch brushes 7 whenever lamp housing 4 is rotated to the protected position. Rotation of lamp housing 4 to the protected position interrupts the conductive path to lamp 3 at this point, thereby turning off power. Although only one switch is required, both of the battery leads are switched in a redundant fashion.

Figure 7:
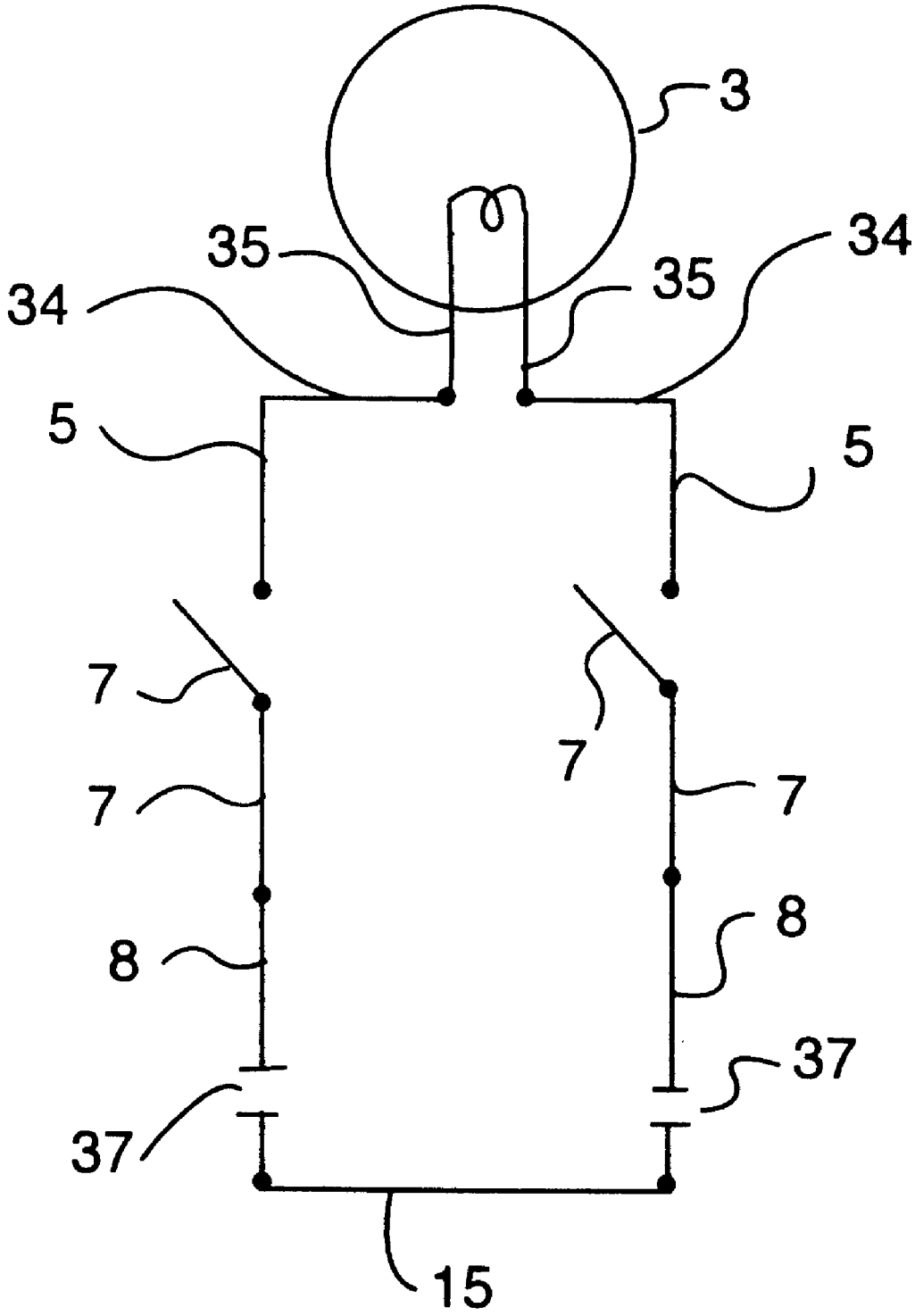
FIG. 7 is an electrical schematic diagram of the electrical circuitry of the flashlight depicted in FIG. 1.

FIG. 7 is a schematic wiring diagram relating the various contacts and conductors to the electrical component parts shown in FIGS. 4 and 6.

It is further known that other modifications may be made to the present invention, without departing from the scope of the invention, as noted in the appended Claims.

I claim:

1. An illuminator, comprising a main housing having one end;

a lamp housing mounted within said main housing; said lamp housing having at least one electrically energized lamp mounted therewithin, said lamp housing being rotatable between a closed lamp-off position and a full-open lamp-on position;

said lamp being electrically connected;

said lamp housing further having means for slow-motion rotation between said closed and full-open positions;

spring means for urging said lamp housing to rotate into said full-open position;

lamp adjustment means for user adjustment of rotation of said lamp and said lamp housing to provide a user desired direction of illumination from said lamp;

electrical switch means for alternately turning said lamp on and off; said illuminator having battery means for energizing said lamp.

2. The illuminator as in claim 1 further comprising an attachment means for attaching said illuminator to a fixed object for convenient illumination of a desired location;

said attachment means further having positional adjustment means for user adjustment of the rotational position of said main housing about vertical, horizontal and longitudinal axes of rotation.

3. The illuminator of claim 1, wherein said lamp adjustment means comprises at least one set of teeth radially mounted on a perimeter of said barrel-shaped lamp housing;

said teeth cooperating with said locking means for providing a plurality of discrete click-stop settings for said lamp housing for allowing said lamp housing and said lamp to be rotated by a user to any one of a plurality of selectable open positions.

4. The illuminator as in claim 1 further comprising a locking means comprising a push-button attached to a spring member, said spring member being mounted within said main housing, wherein user pressure on said push-button causes said spring member to be released, and thereby allowing said barrel-shaped lamp housing to rotate.

5. The illuminator of claim 1, wherein said illuminator is a reading lamp.

6. The illuminator of claim 1, wherein said illuminator is a flashlight.

7. The illuminator as in claim 1 further comprising an attachment means for attaching said illuminator to a fixed object.

8. The illuminator as in claim 7 wherein said means for attaching comprises a grasping clamp assembly having a clip having mounted therein a spring;

said clip being attached to a rotation collar having molded serrations and a bore therethrough with an attachment fastener passing through said bore and into said main housing for attaching said main housing rotatably to said rotation collar.

9. The illuminator of claim 1, wherein said means for slow-motion rotation of said lamp housing between said closed and full-open positions comprises a torsion coil mounted in a drum having a hollow interior for accommodating said spring, said drum being mounted rotatably within a diameter-matching cylinder, wherein said drum and said cylinder are attached within said barrel shaped lamp housing;

said cylinder having an inner surface;

said drum having an outer surface in close proximity to said inner surface of said cylinder;

said outer surface of said drum being provided with friction resistance rotational motion damping means for resisting but not preventing the rotational motion of said drum within said diameter-matching cylinder;

said torsion coil spring being prestressed and torqued so as to bias said lamp housing to assume the open position.

10. The illuminator of claim 9, wherein said rotational motion damping means comprises a coating of friction-producing grease disposed on said outer surface of said drum; said grease comprising a layer disposed between said outer surface of said drum and said inner surface of said diameter-matching cylindrical bore; said grease means for providing a fluid shear counter force to slow the rotational motion of said lamp housing.

11. An illuminator, comprising: a main housing having one end; a barrel-shaped lamp housing mounted within said main housing at said end thereof;

said lamp housing having at least one electrically energized lamp mounted therewithin, said lamp housing being rotatable between a closed lamp-off position and a full-open lamp-on position;

said lamp being electrically connected;

said lamp housing further having means for slow-motion rotation between said closed and full-open positions;

torsion coil spring means for urging said lamp housing to rotate into said full-open position;

lamp adjustment means for user adjustment of rotation of said lamp and said lamp housing to provide a user desired direction of illumination from said lamp;

electrical switch means for alternately turning said lamp on and off; said illuminator having battery means for energizing said lamp;

said illuminator having attachment means for attaching said illuminator to a fixed object for convenient illumination of a desired location;

said attachment means further having positional adjustment means for user adjustment of the rotational position of said main housing about vertical, horizontal and longitudinal axes of rotation.

12. The illuminator of claim 11, wherein said lamp adjustment means comprises at least one set of teeth radially mounted on a perimeter of said barrel-shaped lamp housing;

said teeth cooperating with said locking means for providing a plurality of discrete click-stop settings for said lamp housing for allowing said lamp housing and said lamp to be rotated by a user to any one of a plurality of selectable open positions;

said lamp housing locking means comprising a push-button attached to a spring member, said spring member being mounted within said main housing, said spring member having at least one nib projecting therefrom in releasable contact with said teeth in pawl-and-ratchet fashion, wherein user pressure on said push-button causes said spring member to be released from contact with said teeth, and thereby allowing said barrel-shaped lamp housing to rotate;

said main housing having a battery compartment and door therefor; said battery door having a finger-push releasable spring mounted on said battery compartment door for allowing user access to batteries installed in said battery compartment;

said attachment means for attaching said illuminator to a fixed object comprising a grasping clamp assembly having a clip having mounted therein a spring; said clip being attached to a rotation collar having molded serrations and a bore therethrough with an attachment fastener passing through said bore and into said main housing for attaching said main housing rotatably to said rotation collar.

13. The illuminator of claim 12, wherein said means for slow-motion rotation of said lamp housing between said closed and full-open positions comprises a torsion coil mounted in a drum having a hollow interior for accommodating said spring; said drum being mounted rotatably within a diameter-matching cylinder, wherein said drum and said cylinder are attached within said barrel shaped lamp housing; said cylinder having an inner surface;

said drum having an outer surface in close proximity to said inner surface of said cylinder;

said outer surface of said drum being provided with friction resistance rotational motion damping means for resisting but not preventing the rotational motion of said drum within said diameter-matching cylinder;

said torsion coil spring being prestressed and torqued so as to bias said lamp housing to assume the open position.

14. The illuminator of claim 13, wherein said rotational motion damping means comprises a coating of friction-producing grease disposed on said outer surface of said drum; said grease comprising a layer disposed between said outer surface of said drum and said inner surface of said diameter-matching cylindrical bore; said grease means providing a fluid shear counter force to slow the rotational motion of said lamp housing.

15. The illuminator of claim 14, wherein said illuminator is a reading lamp.

16. The illuminator of claim 14, wherein said illuminator is a flashlight.

* * * * *

UNITED STATES PATENT AND TRADEMARK OFFICE

CERTIFICATE OF CORRECTION

PATENT NO. : 6,142,644
DATED : November 7, 2000
INVENTOR(S) : Sik Leung Chan

It is certified that error appears in the above-identified patent and that said Letters Patent is hereby corrected as shown below:

Inventor's name appears as:
Chan Sik Leung

This name designation should be changed to read as follows:
Sik Leung Chan

Signed and Sealed this

Twelfth Day of June, 2001

Nicholas P. Godici

*Attest:*

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,142,644
DATED : November 7, 2000
INVENTOR(S) : Sik Leung Chan

It is certified that error appears in the above-identified patent and that said Letters Patent is hereby corrected as shown below:

Inventor's name appears as:
Chan Sik Leung

This name designation should be changed to read as follows:
Sik Leung Chan

Signed and Sealed this

Twenty-sixth Day of June, 2001

*Attest:*

Nicholas P. Godici

*Attesting Officer*

NICHOLAS P. GODICI
*Acting Director of the United States Patent and Trademark Office*